US009666123B2

(12) United States Patent
Pak

(10) Patent No.: US 9,666,123 B2
(45) Date of Patent: May 30, 2017

(54) ORGANIC LIGHT EMITTING DISPLAY AND METHOD OF DRIVING THE SAME

(71) Applicant: Samsung Display Co., Ltd., Yongin, Gyeonggi-Do (KR)

(72) Inventor: Sang-Jin Pak, Yongin (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 177 days.

(21) Appl. No.: 14/189,544

(22) Filed: Feb. 25, 2014

(65) Prior Publication Data

US 2014/0240372 A1 Aug. 28, 2014

(30) Foreign Application Priority Data

Feb. 28, 2013 (KR) ..... 10-2013-0022087

(51) Int. Cl.
*G09G 3/32* (2016.01)
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2300/0413* (2013.01); *G09G 2300/0861* (2013.01); *G09G 2320/029* (2013.01); *G09G 2320/043* (2013.01); *G09G 2320/045* (2013.01)

(58) Field of Classification Search
CPC ..... G09G 3/3233; G09G 3/3275; G09G 2300/0413; G09G 2300/0861; G09G 2320/029; G09G 2320/043; G09G 2320/045
USPC ..... 345/76–83, 690; 315/169.3
See application file for complete search history.

(56) References Cited

U.S. PATENT DOCUMENTS

2007/0080905 A1* 4/2007 Takahara ..... G09G 3/3233 345/76
2009/0147032 A1 6/2009 Kim
2011/0074750 A1 3/2011 Leon et al.
2012/0056916 A1* 3/2012 Ryu ..... G09G 3/3208 345/691

FOREIGN PATENT DOCUMENTS

KR 10-2009-0058788 A 6/2009
KR 10-2012-0087138 A 8/2012

* cited by examiner

*Primary Examiner* — Stephen Sherman
(74) *Attorney, Agent, or Firm* — Robert E. Bushnell, Esq.

(57) ABSTRACT

An organic light emitting display capable of improving display quality. The organic light emitting display includes effective pixels positioned in an effective display unit, at least one dummy pixels positioned in a dummy display unit in order to generate light with predetermined luminance, at least one photodiodes arranged on the dummy display unit to be adjacent to the dummy pixels, and a sensing unit for extracting first resistance information from organic light emitting diodes (OLED) included in the effective pixels, extracting second resistance information from OLEDs included in the dummy pixels, and extracting luminance information corresponding to the second resistance information from the photodiodes.

14 Claims, 6 Drawing Sheets

ORGANIC LIGHT EMITTING DISPLAY AND METHOD OF DRIVING THE SAME

CLAIM OF PRIORITY

This application makes reference to, incorporates the same herein, and claims all benefits accruing under 35 U.S.C. §119 from an application earlier filed in the Korean Intellectual Property Office on the 28 Feb. 2013 and there duly assigned Serial No. 10-2013-0022087.

BACKGROUND OF THE INVENTION

Field of the Invention

The present invention relates to an organic light emitting display and a method of driving the same, and more particularly, to an organic light emitting display capable of improving display quality and a method of driving the same.

Description of the Related Art

Recently, various flat panel displays (FPD) capable of reducing weight and volume that are disadvantages of cathode ray tubes (CRT) have been developed. The FPDs include liquid crystal displays (LCD), field emission displays (FED), plasma display panels (PDP), and organic light emitting displays.

Among the flat panel displays (FPD), the organic light emitting display displays an image using organic light emitting diodes (OLEDs) that generate light components by re-combination of electrons and holes. The organic light emitting display has a high response speed and is driven with low power consumption.

In general, the organic light emitting display displays a desired image while supplying currents corresponding to gray scales to the OLEDs arranged in pixels. However, the OLEDs are deteriorated as time goes by so that an image with desired luminance may not be displayed. Actually, when the OLEDs are deteriorated, light with lower luminance is generated to correspond to the same data signal.

In order to solve the above problem, a method of supplying currents to the OLEDs and extracting voltages corresponding to the supplied currents is suggested. However, in the conventional deterioration information extracting method, only a change in resistance values of the OLEDs is extracted such that luminance information of the OLEDs corresponding to deterioration is not extracted. That is, when the deterioration is compensated for using the change in the resistance values of the OLEDs, the deterioration is not correctly compensated for.

SUMMARY OF THE INVENTION

Accordingly, the present invention has been made to provide an organic light emitting display capable of improving display quality and a method of driving the same.

In order to achieve the foregoing and/or other aspects of the present invention, there is provided an organic light emitting display, including pixels positioned in an effective display unit, at least one dummy pixels positioned in a dummy display unit in order to generate light with predetermined luminance, at least one photodiodes arranged on the dummy display unit to be adjacent to the dummy pixels, and a sensing unit for extracting first resistance information from organic light emitting diodes (OLEDs) included in the pixels, extracting second resistance information from OLEDs included in the dummy pixels, and extracting luminance information corresponding to the second resistance information from the photodiodes.

The dummy pixels and the photodiodes are positioned to make pairs. The photodiode provides luminance information corresponding to second resistance information of a dummy pixel adjacent thereto to the sensing unit. Each of the photodiodes is coupled to two adjacent data lines. Each of the photodiodes includes a sensor for generating a voltage corresponding to an amount of light from an adjacent dummy pixel and an amplifier for supplying a current corresponding to the voltage of the sensor as the luminance information to the sensing unit. The sensing unit includes a first transistor coupled between a first power supply and a first node to control an amount of current supplied from the first power supply to the first node to correspond to an amount of the light, a second transistor coupled between the first node and a second power supply set to have a lower voltage than that of the first power supply and turned on when a second control signal is supplied from a second control line, a third transistor coupled between a gate electrode of the first transistor and a first data line and turned on when a scan signal is supplied to a scan line, a first capacitor coupled between the first power supply and the gate electrode of the first transistor, and a second capacitor coupled between the first node and a gate electrode of the second transistor.

The organic light emitting display further includes a control line driver for supplying the second control signal to the second control line, a scan driver for supplying a scan signal to the scan line after the second control signal is supplied, and a data driver for supplying a first dummy data signal to the first data line in synchronization with the scan signal. The first dummy data signal is set so that the same current may flow through the first transistors included in the photodiodes when the light is not supplied. In the first transistor, an activation layer positioned on a rear surface of a gate layer overlaps a light emitting layer of an adjacent dummy pixel in at least a partial region. A plurality of holes are formed in the gate layer so that the activation layer is exposed. The amplifier includes a fourth transistor coupled between a first power supply and a second node to control an amount of current that flows from the first power supply to the second node to correspond to a voltage of the sensing unit, a fifth transistor coupled between the second node and a second power supply set to have a lower voltage than that of the first power supply, a sixth transistor coupled between a gate electrode of the fifth transistor and a second data line and turned on when a scan signal is supplied to a scan line, a seventh transistor coupled between the second node and the second data line and turned on when a third control signal is supplied to a third control line, and a third capacitor coupled between a gate electrode of the fifth transistor and the second power supply.

The organic light emitting display further includes a scan driver for supplying a scan signal to the scan line, a control line driver for supplying the third control signal after the scan signal is supplied, and a data driver for supplying a second dummy data signal to the second data line in synchronization with the scan signal. The second dummy data signal is set so that the same current may be sunken by the fifth transistors included in the photodiodes. The second data line is coupled to the sensing unit in a period where the third control signal is supplied. The sensing unit selects a current supplied from the second data line as the luminance information. The organic light emitting display further includes a memory for storing the first resistance information, the second resistance information, and the luminance information and a timing controller for changing a bit of first data so that deterioration of the OLEDs included in the pixels is compensated for to correspond to the first resistance information, the second resistance information, and the luminance information to generate second data. The organic light emitting display further includes a data driver for supplying data signals to the pixels via data lines to correspond to the second data and supplying dummy data signals corresponding to uniform luminance to the dummy pixels, a scan driver for supplying scan signals to scan lines coupled to the pixels and the dummy pixels, a control line driver for supplying a first control signal to first control lines coupled to the pixels and the dummy pixels, and a switching unit for alternately coupling the sensing unit and the data driver to the data lines.

Each of the pixels and the dummy pixels includes an OLED, a second transistor for controlling an amount of current supplied from a first power supply to the OLED, a first transistor coupled between a data line and a gate electrode of the second transistor and turned on when a scan signal is supplied to a scan line, and a third transistor coupled between an anode electrode of the OLED and the data line and turned on when a first control signal is supplied to a first control line. The sensing unit supplies a predetermined current in a period where the third transistor is turned on to extract a voltage applied to the OLED as the first resistance information or the second resistance information.

There is provided a method of driving an organic light emitting display, including extracting first resistance information from a first OLED of a pixel positioned in an effective display unit, extracting second resistance information from a second OLED of a dummy pixel positioned in a dummy display unit, extracting luminance information from a photodiode positioned to be adjacent to the dummy pixel, and controlling a bit of data so that deterioration information of the first OLED corresponding to the first resistance information may be compensated for to correspond to the second resistance information and the luminance information.

Extracting the first resistance information includes supplying a predetermined current to the first OLED and extracting a voltage applied to the first OLED as the first resistance information to correspond to the predetermined current. Extracting the second resistance information includes supplying a predetermined current to the second OLED and extracting a voltage applied to the second OLED as the second resistance information to correspond to the predetermined current. Extracting the luminance information includes generating an electric signal corresponding to an amount of light from an adjacent dummy pixel and extracting the electric signal as luminance information corresponding to the second resistance information of the adjacent dummy pixel.

In the organic light emitting display according to the present invention and the method of driving the same, deterioration is compensated for using the resistance information of the OLEDs and the luminance information corresponding to the resistance information. In this case, the deterioration of the OLEDs may be correctly compensated for.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
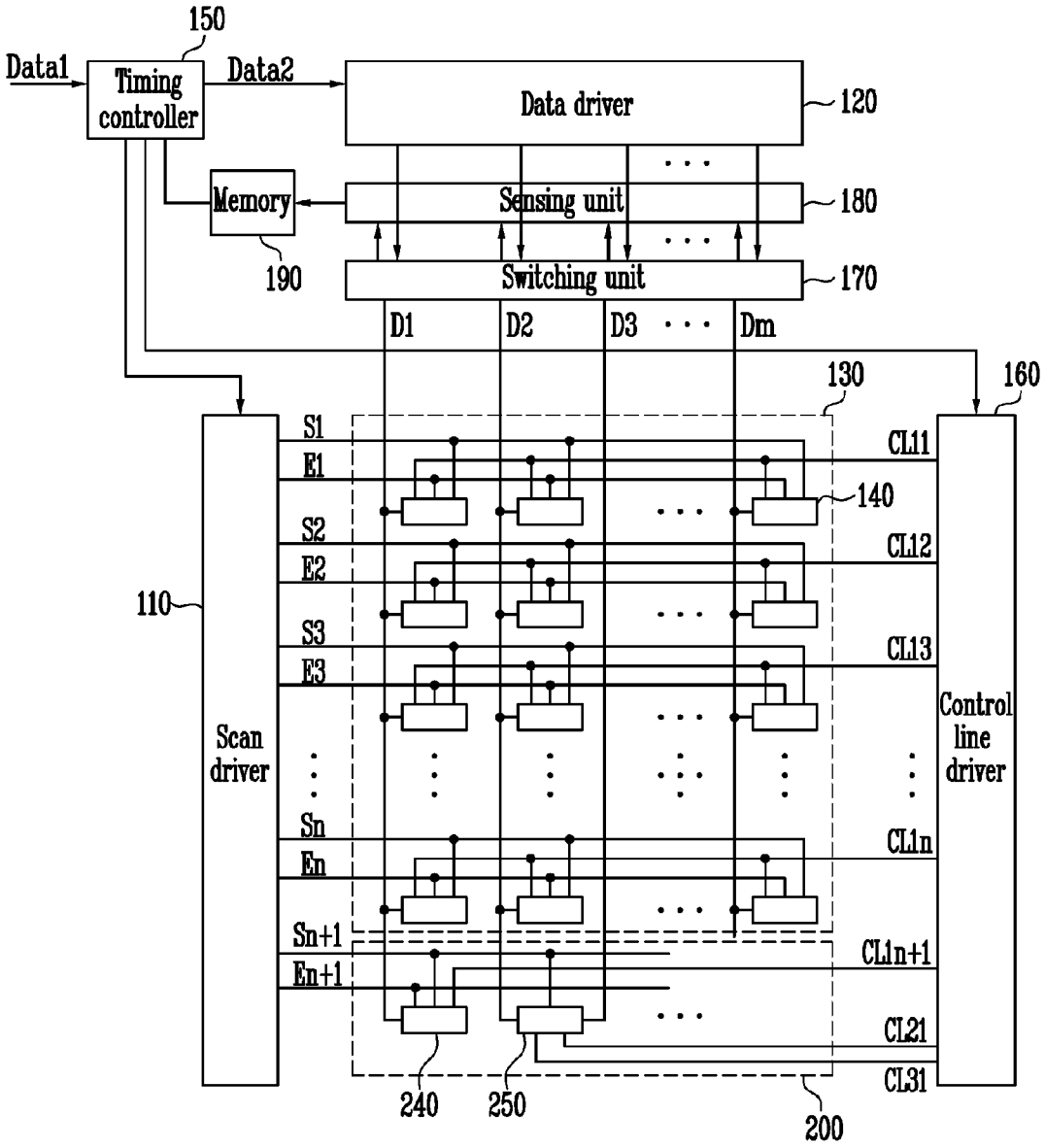
FIG. 1 is a view illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

Hereinafter, an organic light emitting display and a method of driving the same will be described in detail as follows with reference to FIGS. 1 to 8 in which preferred embodiments by which those who skilled in the art may easily perform the present invention are included.

FIG. 1 is a view illustrating an organic light emitting display according to an embodiment of the present invention.

Referring to FIG. 1, an organic light emitting display according to the embodiment of the present invention includes an effective display unit 130, a dummy display unit 200, a scan driver 110, a data driver 120, a timing controller 150, a control line driver 160, a switching unit 170, a sensing unit 180, and a memory 190.

The effective display unit 130 as a region recognized by an observer displays an image. For this purpose, the effective display unit 130 includes pixels 140 positioned at intersections of scan lines S1 to Sn and data lines D1 to Dm. The pixels 140 receive a first power supply ELVDD (not shown) and a second power supply ELVSS (not shown). The pixels 140 realize an image while controlling amounts of currents supplied from the first power supply ELVDD to the second power supply ELVSS via organic light emitting diodes (OLED) to correspond to data signals in a driving period. The pixels 140 supply voltages, applied to the OLEDs, to the sensing unit 180 to correspond to predetermined currents in a sensing period.

The dummy display unit 200 includes a plurality of dummy pixels 240 and a plurality of photodiodes 250. Here, the dummy pixel 240 and the photodiode 250 make a pair to be adjacent to each other. The dummy pixel 240 generates light with predetermined luminance to correspond to a dummy data signal. The photodiode 250 generates an electric signal to correspond to the light supplied from the dummy pixel 240 adjacent thereto. For this purpose, the dummy pixel 240 is electrically coupled to a data line and the photodiode 250 is electrically coupled to two adjacent data lines.

On the other hand, according to the present invention, dummy data signals are supplied in the driving period so that the dummy pixels 240 emit light components. Then, the dummy pixels 240 supply voltages applied to the OLEDs to the sensing unit 180 to correspond to predetermined currents in the sensing period. In addition, in the sensing period, the photodiodes 250 convert the light components emitted from the dummy pixels 240, corresponding to the dummy data signals, into electric signals and supply the electric signals to the sensing unit 180. In this case, information on a change in luminance components of the OLEDs corresponding to a change in resistances of the OLEDs is extracted. Therefore, deterioration of the OLEDs may be stably compensated for. Detailed description of the above will be made later.

The scan driver 110 supplies scan signals to scan lines S1 to Sn+1 positioned in the effective display unit 130 and the dummy display unit 200. For example, the scan driver 110 may sequentially supply the scan signals to the scan lines S1 to Sn+1. On the other hand, in FIG. 1, the scan lines S1 to Sn+1 positioned in the effective display unit 130 and the dummy display unit 200 are driven by one scan driver 110. However, the present invention is not limited to the above. For example, the effective display unit 130 and the dummy display unit 200 may be driven by separate scan drivers.

The control line driver 160 supplies a first control signal to first control lines CL11 to CL1*n*+1 positioned in the effective display unit 130 and the dummy display unit 200. Here, the first control signal may be sequentially supplied to the first control lines CL11 to CL1*n*+1 in the sensing period. In addition, the control line driver 160 supplies a second control signal to at least one second control line CL21 positioned in the dummy display unit 200 and supplies a third control signal to at least one third control line CL31 positioned in the dummy display unit 200. On the other hand, in FIG. 1, the control lines CL11 to CL1*n*+1, CL21, and CL31 positioned in the effective display unit 130 and the dummy display unit 200 are driven by one control line driver 160. However, the present invention is not limited to the above. For example, the effective display unit 130 and the dummy display unit 200 may be driven by separate control line drivers.

The data driver 120 generates data signals using second data Data2 supplied from the timing controller 150 and supplies the generated data signals to the data lines D1 to Dm. Then, the data driver 120 supplies the plurality of dummy data signals to the dummy display unit 200 so that resistance information and luminance information of the OLEDs may be extracted. Detailed description of the above will be performed later.

The switching unit 170 selectively couples the sensing unit 180 and the data driver 120 to the data lines D1 to Dm. For this purpose, the switching unit 170 includes a pair of switching elements coupled to each of the data lines D1 to Dm (that is, in each channel).

The sensing unit 180 extracts first resistance information items of the OLEDs from the pixels 140 positioned in the effective display unit 130 and extracts second resistance information items of the OLEDs from the dummy pixels 240. Then, the sensing unit 180 extracts luminance information items corresponding to the second resistance information items from the photodiodes 250.

The memory 190 stores the first resistance information items, the second resistance information items, and the luminance information items extracted from the sensing unit 180.

The timing controller 150 changes a bit of the first data Data1 to correspond to the resistance information items and the luminance information items stored in the memory 190 to generate the second data Data2 and supplies the generated second data Data2 to the data driver 120. For example, the timing controller 150 grasps the information on the change in the luminance components of the OLEDs corresponding to the change in the resistances of the OLEDs using the second resistance information items and the luminance information items. In this case, the information on the change in the luminance components of the OLEDs corresponding to the first resistance information items may be extracted. Therefore, the timing controller 150 changes the bit of the first data Data1 so that the deterioration, that is, the luminance components of the OLEDs may be compensated for to correspond to the first resistance information items to generate the second data Data2. Here, the second data Data2 corresponds to the effective display unit 130.

Figure 2:
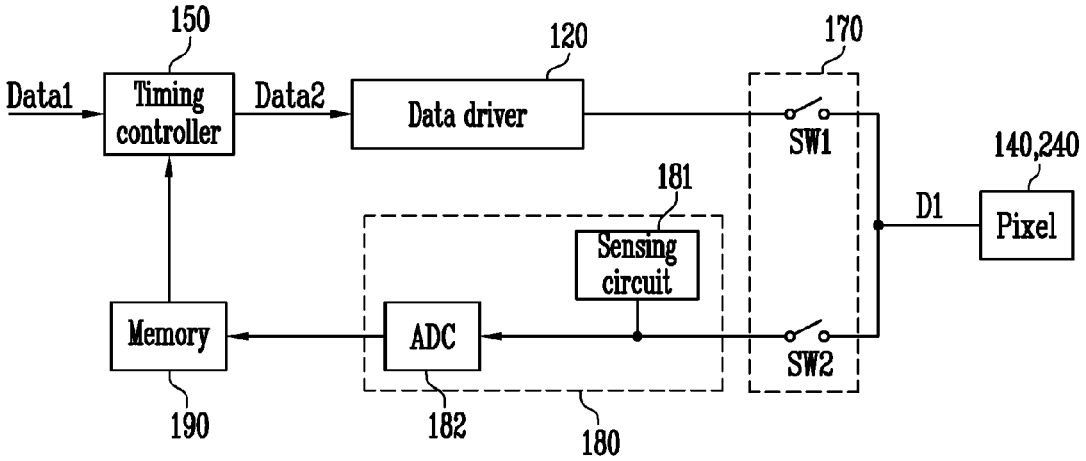
FIG. 2 is a view schematically illustrating the switching unit and the sensing unit illustrated in FIG. 1.

FIG. 2 is a view schematically illustrating the switching unit and the sensing unit illustrated in FIG. 1. In FIG. 2, for convenience sake, the switching unit and the sensing unit are coupled to the first data line D1.

Referring to FIG. 2, a pair of switching elements SW1 and SW2 are provided in each channel of the switching unit 170. A sensing circuit 181 and an analog-to-digital converter (hereinafter, referred to as ADC) 182 are provided in each channel of the sensing unit 180. Here, the ADC 182 may be formed in each of a plurality of channels.

The first switching element SW1 is positioned between the data driver 120 and the data line D1. The first switching element SW1 is turned on when the data signal and the dummy data signal are supplied from the data driver 120.

The second switching element SW2 is positioned between the sensing unit 180 and the data line D1. The second switching element SW2 is turned on when the first resistance information items and the second resistance information items are extracted. In this case, the first switching element SW1 and the second switching element SW2 are alternately turned on and off.

On the other hand, as will be explained in more detail later, the first switching element SW1 and the second switching element SW2 are coupled (not shown in FIG. 2) to each of the data lines D2 and D3 coupled to the photodiode 250 shown in FIG. 1. The first switching element SW1 electrically coupled to the photodiode 250 is turned on when the data signals and the dummy data signals are supplied from the data driver 120. The second switching element SW2 electrically coupled to the photodiode 250 is turned on when luminance information is extracted.

The sensing circuit 181 supplies a predetermined current to the pixel 140 and the dummy pixel 240 in a period where the first resistance information items and the second resistance information items are extracted. At this time, the current supplied from the sensing circuit 181 flows via the OLED included in the pixel 140 or the OLED included in the dummy pixel 240. At this time, a voltage applied to the OLED is supplied to the ADC 182 as the first resistance information or the second resistance information. On the other hand, since a resistance value of the OLED is changed to correspond to deterioration of the OLED, deterioration information is included in the first resistance information and the second resistance information. Additionally, the current supplied from the sensing circuit 181 may be variously set so that a predetermined voltage may be applied within a predetermined time. For example, the sensing circuit 181 may be set to have a current to be flown to the OLED when the pixels 140 and 240 emit light with maximum luminance.

On the other hand, in the above, it is described that a predetermined current is supplied from the sensing circuit 181. However, the present invention is not limited to the above. For example, the sensing circuit 181 may additionally extract information on a threshold voltage of a driving transistor included in the pixels 140 and 240 while sinking the predetermined current.

The ADC 182 converts the first resistance information, the second resistance information, and the luminance information supplied thereto into digital values to store the digital values in the memory 190.

The memory 190 stores the first resistance information, the second resistance information, and the luminance information supplied from the ADC 182 as the digital values.

The timing controller 150 extracts a change in luminance corresponding to a change in resistance using the second resistance information and the luminance information. Then, the timing controller 150 changes a bit of the first data Data1 so that the luminance may be compensated for to correspond to the first resistance information to generate the second data Data2. That is, the timing controller 150 controls a bit of the data using luminance information as well as resistance information. In this case, loss of luminance corresponding to the deterioration of the OLED may be correctly compensated for.

The data driver 120 generates a data signal using the second data Data2 and supplies the generated data signal to the pixel 240.

Figure 3:
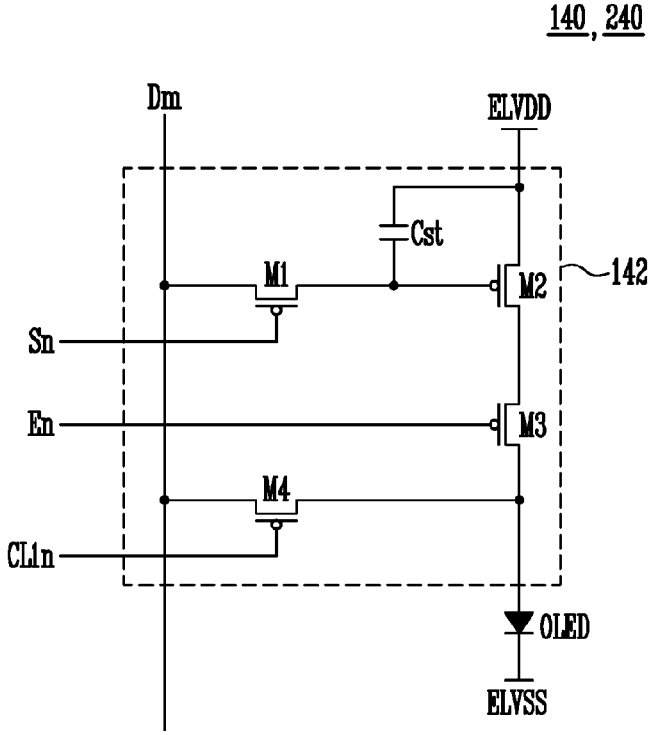
FIG. 3 is a view illustrating a pixel according to an embodiment of the present invention.

FIG. 3 is a view illustrating a pixel according to an embodiment of the present invention. According to the present invention, the pixel 140 and the dummy pixel 240 are formed of the same circuit.

Referring to FIG. 3, the pixels 140 and 240 according to the embodiment of the present invention includes an OLED, and a circuit pixel 142 for supplying a current to the OLED.

An anode electrode of the OLED is coupled to the OLED is coupled to the pixel circuit 142 and a cathode electrode of the OLED is coupled to a second power supply ELVSS. The OLED generates light with predetermined luminance to correspond to the current supplied from the pixel circuit 142.

The pixel circuit 142 receives a data signal or a dummy data signal from the data line Dm when the scan signal is supplied to the scan line Sn. In addition, the pixel circuit 142 receives a predetermined current from the sensing circuit 181 when a control signal is supplied to a control line CLn and supplies a voltage (that is, first resistance information or second resistance information) corresponding to the received current to the ADC 182. For this purpose, the pixel circuit 142 includes four transistors M1 to M4 and a storage capacitor Cst.

A gate electrode of the first transistor M1 is coupled to the scan line Sn and a first electrode of the first transistor M1 is coupled to the data line Dm. A second electrode of the first transistor M1 is coupled to a first terminal of the storage capacitor Cst. The first transistor M1 is turned on when the scan signal is supplied to the scan line Sn. Here, the scan signal is supplied in a period where a voltage corresponding to the data signal or the dummy data signal is charged in the storage capacitor Cst.

A gate electrode of the second transistor M2 is coupled to the first terminal of the storage capacitor Cst and a first electrode of the second transistor M2 is coupled to a second terminal of the storage capacitor Cst and to the first power supply ELVDD. The second transistor M2 controls an amount of current that flows from the first power supply ELVDD to the second power supply ELVSS via the OLED to correspond to the voltage stored in the storage capacitor Cst. At this time, the OLED generates light corresponding to an amount of current supplied from the second transistor M2.

A gate electrode of the third transistor M3 is coupled to an emission control line En and a first electrode of the third transistor M3 is coupled to a second electrode of the second transistor M2. A second electrode of the third transistor M3 is coupled to the OLED. The third transistor M3 is turned off when an emission control signal is supplied to the emission control line En and is turned on when the emission control signal is not supplied. Here, the emission control signal is supplied in a period where the voltage corresponding to the data signal is charged in the storage capacitor Cst and in a period where the resistance information of the OLED is sensed.

A gate electrode of the fourth transistor M4 is coupled to a first control line CL1*n* and a first electrode of the fourth transistor M4 is coupled to the second electrode of the third transistor M3. In addition, a second electrode of the fourth transistor M4 is coupled to the data line Dm. The fourth transistor M4 is turned on when the control signal is supplied to the first control line CL1*n* and is turned off in the other cases.

The storage capacitor Cst is coupled between the gate electrode of the second transistor M2 and the first power supply ELVDD. The storage capacitor Cst charges the voltage corresponding to the data signal or the dummy data signal.

When operation process are briefly described, the first transistors M1 included in the pixels 140 positioned in the effective display unit 130 are turned on in units of lines to correspond to the scan signals in the driving period (where the first switching element SW1 is turned on). When the first transistor M1 is turned on, the data signal from the data line Dm is supplied to the storage capacitor Cst and the voltage corresponding to the data signal is charged in the storage capacitor Cst. In a period where the voltage is charged in the storage capacitor Cst, the third transistor M3 is turned off to correspond to the emission control signal supplied to the emission control line En. For this purpose, in the driving period, the scan signal supplied to the ith (i is a natural number) scan line Si overlaps an emission control signal supplied to an ith emission control line Ei. Then, the second transistor M2 supplies a predetermined current to the OLED to correspond to the voltage charged in the storage capacitor Cst to generate light with predetermined luminance.

The first transistors M1 included in the dummy pixels 240 positioned in the dummy display unit 200 are turned on in units of lines to correspond to the scan signals coupled to the scan line Sn+1 (see FIG. 1) in the driving period. When the first transistor M1 is turned on, the dummy data signal from the data line Dm is supplied to the storage capacitor Cst so that the voltage corresponding to the dummy data signal is charged in the storage capacitor Cst. In a period where the voltage is charged in the storage capacitor Cst, the third transistor M3 is turned off to correspond to an emission control signal supplied to an emission control line En+1. Then, the second transistor M2 supplies a predetermined current to the OLED to correspond to the voltage charged in the storage capacitor Cst to generate light with predetermined luminance.

As described above, in the driving period, the pixels 140 positioned in the effective display unit 130 realize a predetermined image to correspond to the data signal. The dummy pixels 240 positioned in the dummy display unit 200 emit light with predetermined luminance to correspond to the dummy data signal. Here, the light generated by the dummy pixels 240 is not observed by a viewer. Actually, according to the present invention, the dummy data signal is experimentally determined so that the OLED included in the dummy pixel 240 may be deteriorated. For example, the dummy data signal corresponding to the highest gray scale may be supplied so that the OLED included in the dummy pixel 240 may be deteriorated at a high speed.

In the sensing period (where the second switching element SW2 is turned on), the first control signal is sequentially supplied to the first control signal lines CL11 to CL1*n*+1. Then, the fourth transistors M4 included in the pixels 140 and 240 are turned on in units of lines. When the fourth transistor M4 is turned on, a predetermined current from the sensing circuit 181 is supplied to the OLED. Then, the ADC 182 converts a voltage applied to the OLED into a digital value as first resistance information or second resistance information to store the digital value in the memory 190. That is, in the sensing period, the resistance information included in the pixels 140 and 240 is extracted to be stored in the memory 190.

On the other hand, according to the present invention, the structure of the pixels 140 and 240 is not limited to that of FIG. 3. Actually, the pixels 140 and 240 according to the present invention may be applied in various forms including the fourth transistor M4 so that deterioration information may be extracted. For example, the pixel 140 according to the present invention may be selected as one of currently well-known various circuits.

Figure 4:
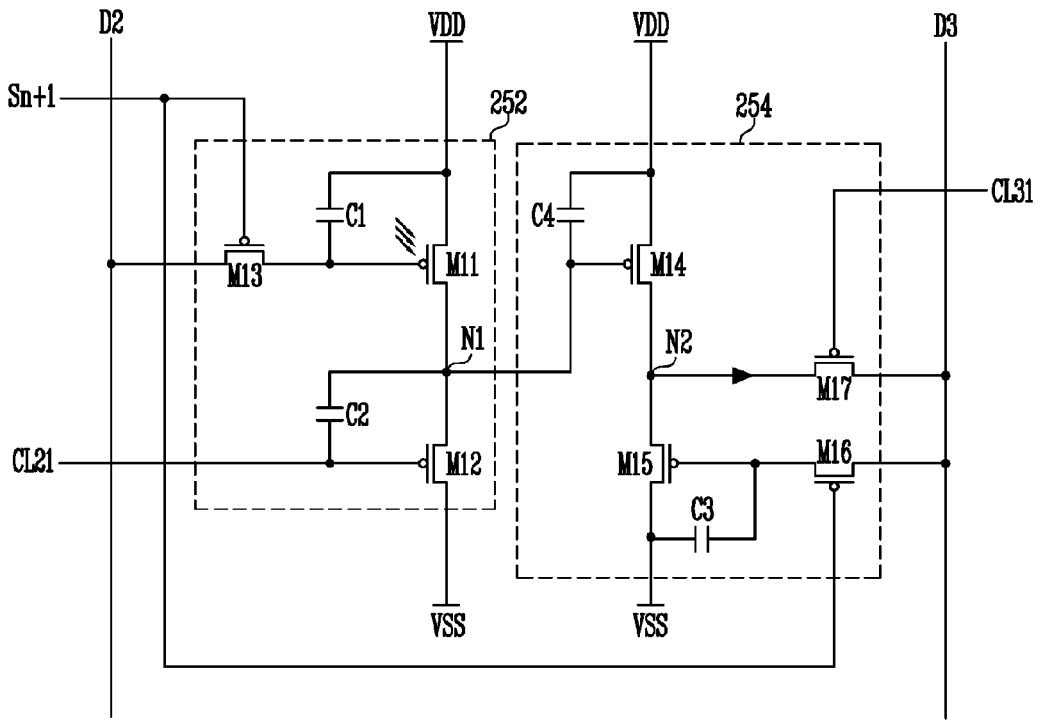
FIG. 4 is a drawing illustrating a photodiode according to an embodiment of the present invention.

FIG. 4 is a drawing illustrating a photodiode according to an embodiment of the present invention.

Referring to FIG. 4, a photodiode according to the embodiment of the present invention includes a sensor 252 and an amplifier 254.

The sensor 252 senses light from an adjacently paired dummy pixel 240 and supplies a voltage (or a current) corresponding to the sensed light. For this purpose, the sensor 252 includes a first transistor M11 to a third transistor M13, a first capacitor C1, and a second capacitor C2.

The first transistor M11 is coupled between a third power supply VDD and a first node N1. The first transistor M11 controls an amount of current supplied from the third power supply VDD to the first node N1 to correspond to the amount of light supplied from the adjacent dummy pixel 240.

The second transistor M12 is coupled between the first node N1 and a fourth power supply VSS. A gate electrode of the second transistor M12 is coupled to the second control line CL21. The second transistor M12 is turned on when the second control signal is supplied to the second control line CL21 and is turned off in the other cases. Here, the fourth power supply VSS is set to have a voltage lower than that of the third power supply VDD. For example, the third power supply VDD may be set as the first power supply ELVDD and the fourth power supply VSS may be set as the second power supply ELVSS.

The third transistor M13 is coupled between the data line D2 and the gate electrode of the first transistor M11. A gate electrode of the third transistor M13 is coupled to the scan line Sn+1. The third transistor M13 is turned on when the scan signal is supplied to the scan line Sn+1 to electrically couple the data line D2 and the gate electrode of the first transistor M11 to each other.

The first capacitor C1 is coupled between a gate electrode of the first transistor M11 and the third power supply VDD. The first capacitor C1 charges a voltage corresponding to a first dummy data signal supplied from the data line D2 when the third transistor M13 is turned on. Here, the first dummy data signal is set so that the same current (dark current) flows through the first transistors M11 included in the photodiodes 250 when light is not supplied.

To be specific, the first transistors M11 included in the photodiodes 250 may supply different currents to the first node N1 by the same amount of light due to a process deviation. When the different currents are supplied from the photodiodes 250 to the first node N1 to correspond to the same amount of light, reliability of luminance information is deteriorated.

Therefore, according to the present invention, in a period where the scan signal is supplied to the scan line Sn+1, the photodiodes 250 receive different first dummy data signals. Here, the first dummy data signals are experimentally determined so that the same dark current may flow through the first transistors M11 included in the photodiodes 250.

The second capacitor C2 is coupled between the gate electrode of the second transistor M12 and the first node N1. The second capacitor C2 converts a current supplied from the first transistor M11 into a voltage.

The amplifier 254 amplifies a current to correspond to a voltage of the first node N1 and supplies the amplified current to the data line D3. For this purpose, the amplifier 254 includes a fourth transistor M14 to a seventh transistor M17, a third capacitor C3 and a fourth capacitor C4.

The fourth transistor M14 is coupled between the third power supply VDD and a second node N2. A gate electrode of the fourth transistor M14 is coupled to the first node N1. The fourth capacitor C4 is coupled between the gate electrode of the fourth transistor M14 and the third power supply VDD. The fourth capacitor C4 charges a voltage corresponding the first node N1. The fourth transistor M14 controls an amount of current supplied from the third power supply VDD to the second node N2 to correspond to a voltage applied to the first node N1.

The fifth transistor M15 is coupled between the second node N2 and the fourth power supply VSS. A gate electrode of the fifth transistor M15 is coupled to a second electrode of the sixth transistor M16. The fifth transistor M15 sinks a predetermined current to correspond to a voltage charged in the third capacitor C3.

The sixth transistor M16 is coupled between the gate electrode of the fifth transistor M15 and the data line D3. A gate electrode of the sixth transistor M16 is coupled to the scan line Sn+1. The sixth transistor M16 is turned on when the scan signal is supplied to the scan line Sn+1 to electrically couple the data line D3 and the gate electrode of the fifth transistor M15 to each other.

The seventh transistor M17 is coupled between the second node N2 and the data line D3. A gate electrode of the seventh transistor M17 is coupled to the third control line CL31. The seventh transistor M17 is turned on when the third control signal is supplied to the third control line CL31 to electrically couple the data line D3 and the second node N2 to each other.

The third capacitor C3 is coupled between the gate electrode of the fifth transistor M15 and the fourth power supply VSS. The third capacitor C3 receives a second dummy data signal from the data line D3 when the sixth transistor M16 is turned on. Here, the second dummy data signal is set so that the same current is sunken by the fifth transistors M15 included in the photodiodes 250.

To be specific, threshold voltages of the fourth transistor M14 and the fifth transistor M15 included in the photodiodes 250 are set to be different due to the process deviation. Therefore, according to the present invention, different second dummy data signals are supplied to the photodiodes 250 so that the process deviation may be compensated for. Here, the second dummy data signals are experimentally determined so that the same current is sunken by the fifth transistors M15 included in the photodiodes 250.

The current sunken by the fifth transistor M15 flows from the third power supply VDD to the fourth power supply VSS via the fourth transistor M14, the second node N2, and the fifth transistor M15. In this case, operation points of the fourth transistors M14 included in the photodiodes 250 coincide with each other so that the process deviation may be compensated for. On the other hand, a current that flows to correspond to the voltage applied to the first node N1 is supplied to the third data line D3 via the seventh transistor M17. Here, the current that flows to the third data line D3, that is, an amplification ratio is controlled to correspond to a ratio of channel width to length (W/L) of the fourth transistor M14 and the fifth transistor M15.

Figure 5:
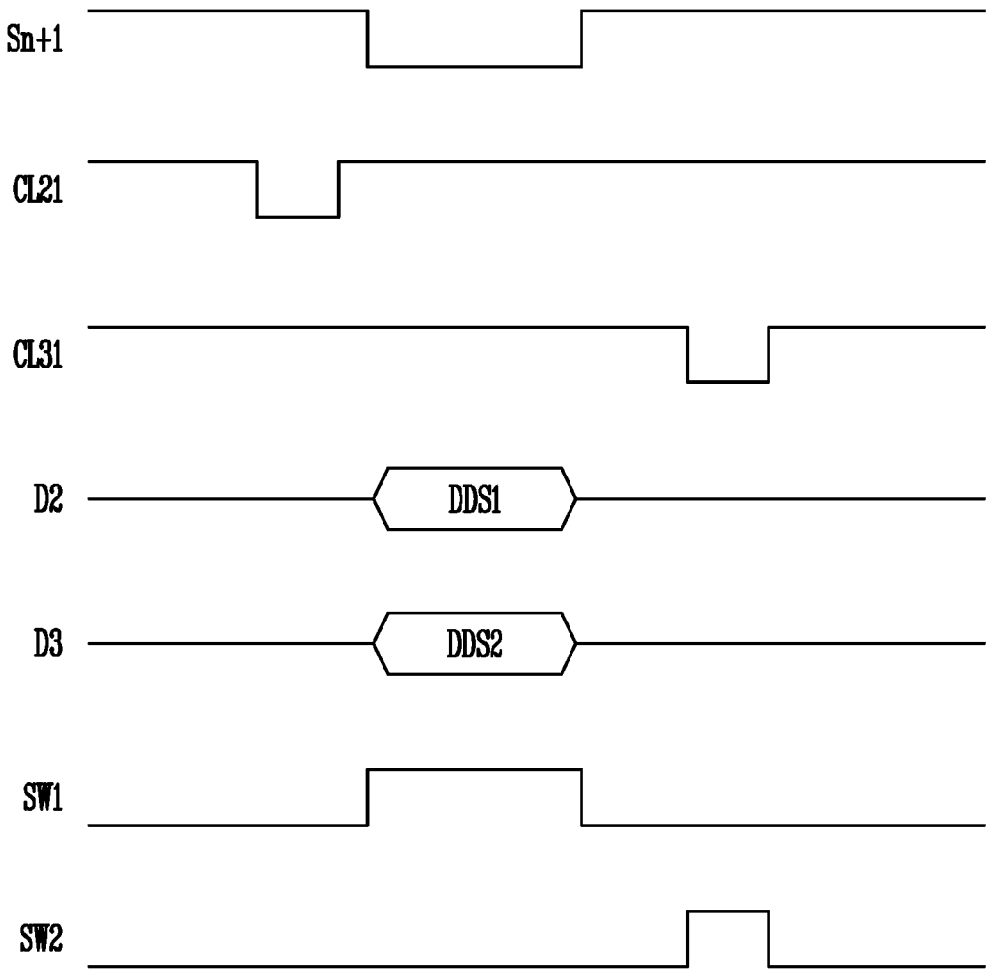
FIG. 5 is a waveform diagram illustrating operation processes of the photodiode illustrated in FIG. 4.

FIG. 5 is a waveform diagram illustrating operation processes of the photodiode illustrated in FIG. 4.

Referring to FIG. 5, the second control signal is supplied to the second control line CL21 so that the second transistor M12 is turned on. When the second transistor M12 is turned on, a voltage of the fourth power supply VSS is supplied to the first node N1 so that the second capacitor C2 is initialized.

Then, the scan signal is supplied to the scan line Sn+1, a first dummy data signal DDS1 is supplied to the second data line D2, and a second dummy data signal DDS2 is supplied to the third data line D3.

When the scan signal is supplied to the scan line Sn+1, the third transistor M13 and the sixth transistor M16 are turned on. When the third transistor M13 is turned on, the first dummy data signal DDS1 from the second data line D2 is supplied to the gate electrode of the first transistor M11 so that a voltage corresponding to the first dummy data signal DDS1 is charged in the first capacitor C1.

When the sixth transistor M16 is turned on, the second dummy data signal DDS2 from the third data line D3 is supplied to the gate electrode of the fifth transistor M15 so that a voltage corresponding to the second dummy data signal DDS2 is charged in the third capacitor C3.

When the voltage corresponding to the first dummy data signal DDS1 is charged in the first capacitor C1 and the voltage corresponding to the second dummy data signal DDS2 is charged in the third capacitor C3, the process deviations of the first transistor M11 and the fourth transistor M14 may be compensated for. On the other hand, in a period where the first and second dummy data signals DDS1 and DDS2 are supplied, the first switching element SW1 is turned on so that the data lines D2 and D3 and the data driver 120 are electrically coupled to each other.

Then, the first transistor M11 receives light from the adjacent dummy pixel 240 and supplies a current corresponding to the light to the first node N1. Then, a voltage corresponding to luminance of the light of the dummy pixel 240 is applied to the first node N1. When the voltage is applied to the first node N1, the fourth transistor M14 supplies a current to the second node N2 to correspond to the voltage of the first node N1.

Then, the third control signal is supplied to the third control line CL31 so that the seventh transistor M17 is turned on. When the seventh transistor M17 is turned on, the current supplied from the fourth transistor M14 is supplied to the third data line D3. That is, in the current supplied from the fourth transistor M14 to the second node N2, a current excluding a current sunken by the fifth transistor M15, that is, a current corresponding to an amount of light of the dummy pixel 240 is supplied to the third data line D3. At this time, since the second switching element SW2 is turned on, the current supplied to the third data line D3, that is, luminance information is converted into a digital signal to be stored in the memory 190. Actually, the photodiode 250 according to the present invention repeats the above processes to supply the luminance information to the sensing unit 180.

Additionally, according to the present invention, an activation layer of the first transistor M11 is positioned on a rear surface of a light emitting layer (that is, the OLED) of the adjacent dummy pixel 240. When the activation layer of the first transistor M11 is positioned on the rear surface of the light emitting layer of the adjacent dummy pixel 240, the light from the dummy pixel 240 may be stably supplied to the first transistor M11.

Figure 6:
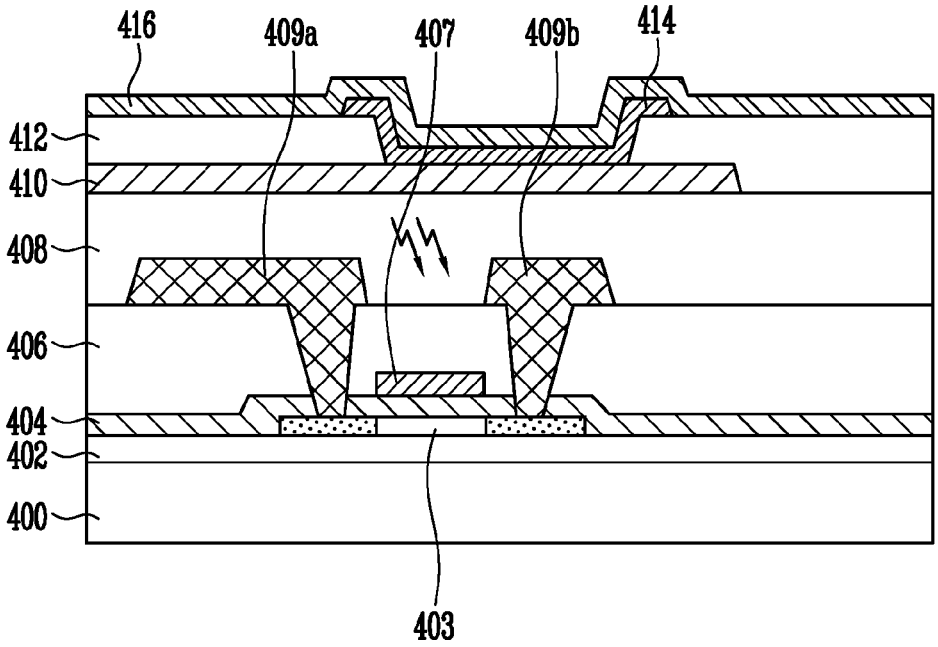
FIG. 6 is a sectional view schematically illustrating a structure of the first transistor illustrated in FIG. 4 according to a first embodiment.

FIG. 6 is a sectional view schematically illustrating a structure of the first transistor of the photodiode illustrated in FIG. 4 with respect to the adjacent dummy pixel according to a first embodiment.

Referring to FIG. 6, a buffer layer 402 and an activation layer 403 are sequentially formed on a substrate 400. Then, a first insulating layer 404 and a conductive layer 407 are sequentially formed on the activation layer 403 and the buffer layer 402 including the substrate 400. Here, the conductive layer 407 (or a gate layer) may be formed of no less than two layers and is used as the gate electrode of the first transistor M11. For this purpose, the conductive layer 407 may be formed of a transparent conductive material.

After the gate electrode 407 is formed, a transparent second insulating layer 406 is formed. The second insulating layer 406 is patterned so that the activation layer 403 of a source region and a drain region is exposed. After the second insulating layer 406 is patterned, a source electrode 409*a* and a drain electrode 409*b* coupled to the activation layer 403 are formed.

After the source electrode 409*a* and the drain electrode 409*b* are formed, a third insulating layer 408 is formed. After the third insulating layer 408 is formed, an anode electrode 410 and a pixel defining layer 412 patterned on the anode electrode to a predetermined shape is formed. An organic light emitting layer 414 is formed in an aperture exposed by the pixel defining layer 412 being patterned and a cathode electrode 416 is formed to cover the organic light emitting layer 414.

Actually, according to the present invention, the first transistor M11 may have various structures in which light is received so that an amount of current may be controlled. According to the present invention, a partial region of the gate layer 407 (that is, the activation layer 403) of the first transistor M11 overlaps the light emitting layer 414 of the adjacent dummy pixel 240. In this case, the first transistor M11 may stably receive light from the light emitting layer 414 so that reliability may be improved.

Figure 7:
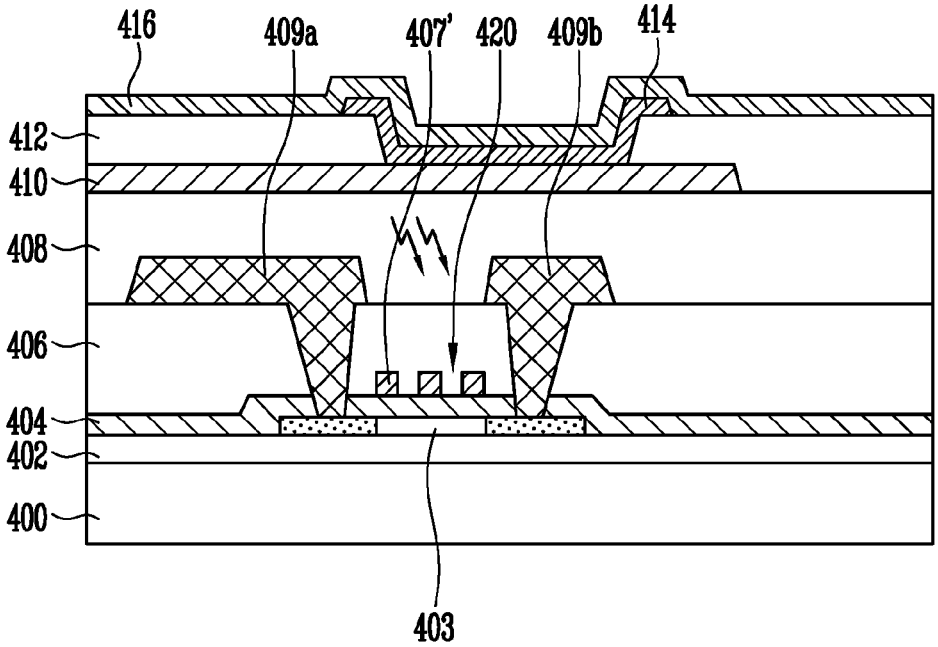
FIG. 7 is a sectional view schematically illustrating a structure of the first transistor illustrated in FIG. 4 according to a second embodiment.

FIG. 7 is a sectional view schematically illustrating a structure of the first transistor illustrated in FIG. 4 according to a second embodiment. In describing FIG. 7, the same elements as those of FIG. 6 are denoted by the same reference numerals and detailed description thereof will be omitted.

Referring to FIG. 7, according to the second embodiment of the present invention, in a gate electrode 407' of the first transistor M11, a plurality of holes 420 are formed so that the activation layer 403 is exposed. Then, an amount of light supplied from the light emitting layer 414 to the activation layer 403 is increased so that stability of driving may be secured.

Figure 8:
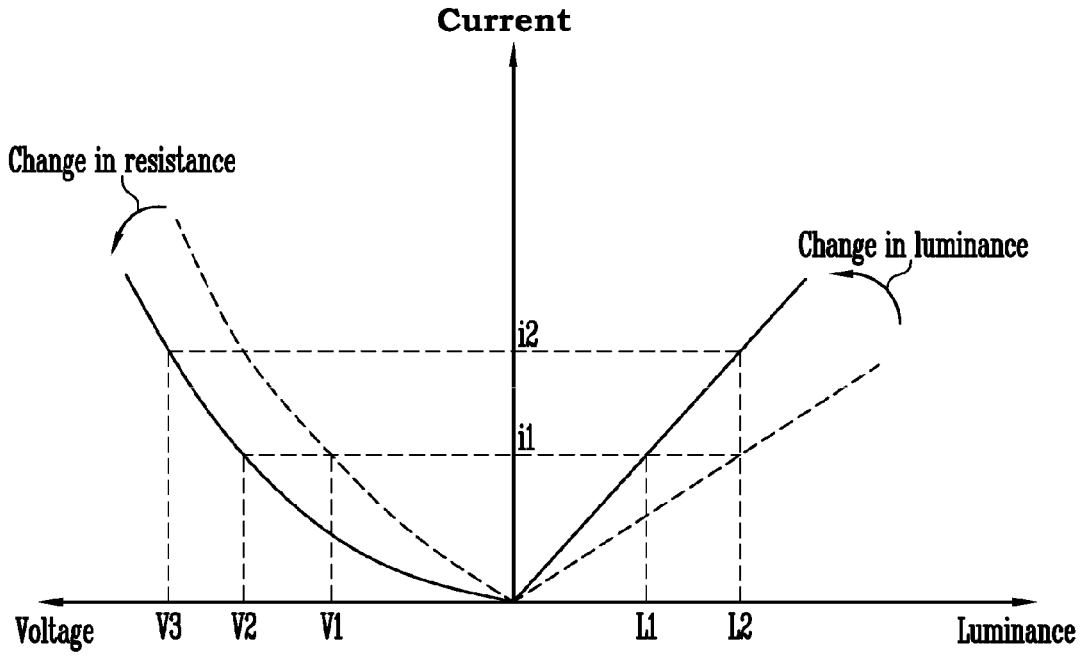
FIG. 8 is a view illustrating a change in resistances and luminance components corresponding to deterioration of organic light emitting diodes (OLED).

FIG. 8 is a view illustrating a change in resistances and luminance components corresponding to deterioration of organic light emitting diodes (OLED).

Referring to FIG. 8, when the OLED is deteriorated, resistance and luminance are changed. For example, before the OLED is deteriorated, a first voltage V1 is applied to correspond to a first current i1 and light is emitted with second luminance L2.

However, when the OLED is deteriorated, a second voltage V2 higher than the first voltage V1 is applied to the OLED to correspond to the first current i1. The OLED generates light of first luminance L1 darker than the second luminance L2.

Actually, when the OLED is deteriorated, in order to generate the second luminance L2, a second current i2 higher than the first current i1 must be supplied. In this case, a third voltage V3 is applied to the OLED to correspond to the second current i2.

As described above, the resistance and luminance of the OLED are changed to correspond to the deterioration of the OLED. According to the present invention, the resistance information corresponding to the deterioration of the OLED is extracted from the dummy pixel 240 and the luminance information corresponding to the deterioration of the OLED is extracted from the photodiode 250. The deterioration of the OLED is compensated for using the resistance information and the luminance information so that the deterioration of the OLED may be stably compensated for.

On the other hand, according to the present invention, for convenience sake, the transistors are illustrated as PMOS transistors. However, the present invention is not limited to the above. That is, the transistors may be NMOS transistors.

In addition, according to the present invention, the OLED generates red, green, or blue light to correspond to the amount of current supplied from the driving transistor. However, the present invention is not limited to the above. For example, the OLED may generate white light to correspond to an amount of current supplied form the driving transistor. In this case, a color image is realized using an additional color filter.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display, comprising:

effective pixels positioned in an effective display unit to display an image;

at least one dummy pixel positioned in a dummy display unit in order to generate light with predetermined luminance;

at least one photodiode arranged on the dummy display unit to be paired with and adjacent to the dummy pixel to detect light emitted by the dummy pixel; and a sensing unit disposed to extract first resistance information from organic light emitting diodes (OLED) included in the effective pixels, extract second resistance information from an OLED included in the dummy pixel, and extract luminance information corresponding to the second resistance information from the photodiodes, wherein each of the photodiodes is coupled to two adjacent data lines, wherein each of the photodiodes comprises:

a sensor for generating a voltage corresponding to an amount of light from the adjacent dummy pixel; and an amplifier for supplying a current corresponding to the voltage of the sensor as the luminance information to the sensing unit, wherein the sensor comprises:

a first transistor coupled between a first power supply and a first node to control an amount of current supplied from the first power supply to the first node to correspond to an amount of the light from the adjacent dummy pixel;

a second transistor coupled between the first node and a second power supply set to have a lower voltage than that of the first power supply and turned on when a second control signal is supplied from a second control line;

a third transistor coupled between a gate electrode of the first transistor and a first data line and turned on when a scan signal is supplied to a scan line;

a first capacitor coupled between the first power supply and the gate electrode of the first transistor; and a second capacitor coupled between the first node and a gate electrode of the second transistor.

2. The organic light emitting display as claimed in claim 1, wherein the dummy display unit includes a plurality of dummy pixels and the photodiodes adjacently positioned to make pairs, and wherein each of the photodiodes provides luminance information corresponding to second resistance information of the correspondingly paired dummy pixel to the sensing unit.

3. The organic light emitting display as claimed in claim 1, further comprising:

a control line driver supplying the second control signal to the second control line;

a scan driver supplying a scan signal to the scan line after the second control signal is supplied; and a data driver supplying a first dummy data signal to the first data line in synchronization with the scan signal.

4. The organic light emitting display as claimed in claim 3, wherein the first dummy data signal is set so that the same current may flow through the first transistors included in the photodiodes when the light is not supplied.

5. The organic light emitting display as claimed in claim 1, wherein, in the first transistor, an activation layer positioned on a rear surface of a gate layer overlaps a light emitting layer of the adjacent dummy pixel in at least a partial region.

6. The organic light emitting display as claimed in claim 5, wherein a plurality of holes are formed in the gate layer so that the activation layer is exposed.

7. The organic light emitting display as claimed in claim 1, wherein the amplifier comprises:

a fourth transistor coupled between a first power supply and a second node to control an amount of current that flows from the first power supply to the second node to correspond to a voltage of the sensor, the fourth transistor having a gate electrode coupled to the the sensor;

a fifth transistor coupled between the second node and a second power supply set to have a lower voltage than that of the first power supply;

a sixth transistor coupled between a gate electrode of the fifth transistor and a second data line and turned on when a scan signal is supplied to a scan line;

a seventh transistor coupled between the second node and the second data line and turned on when a third control signal is supplied to a third control line;

a third capacitor coupled between a gate electrode of the fifth transistor and the second power supply; and a fourth capacitor coupled between the gate electrode of the fourth transistor and the first power supply.

8. The organic light emitting display as claimed in claim 7, further comprising:

a scan driver supplying a scan signal to the scan line;

a control line driver supplying the third control signal after the scan signal is supplied; and a data driver supplying a second dummy data signal to the second data line in synchronization with the scan signal.

9. The organic light emitting display as claimed in claim 8, wherein the second dummy data signal is set so that the same current may be sunken by the fifth transistors included in the photodiodes.

10. The organic light emitting display as claimed in claim 7, wherein the second data line is coupled to the sensing unit in a period where the third control signal is supplied, and wherein the sensing unit selects a current supplied from the second data line as the luminance information.

11. The organic light emitting display as claimed in claim 1, further comprising:

a memory storing the first resistance information, the second resistance information, and the luminance information; and a timing controller changing a bit of first data so that deterioration of the OLEDs included in the effective pixels is compensated to correspond to the first resistance information, the second resistance information, and the luminance information to generate second data.

12. The organic light emitting display as claimed in claim 11, further comprising:

a data driver supplying data signals to the effective pixels via data lines to correspond to the second data and supplying dummy data signals corresponding to uniform luminance to the dummy pixels;

a scan driver supplying scan signals to scan lines coupled to the effective pixels and the dummy pixels;

a control line driver supplying a first control signal to first control lines coupled to the effective pixels and the dummy pixels; and a switching unit alternately coupling the sensing unit and the data driver to the data lines.

13. An organic light emitting display, comprising:

effective pixels positioned in an effective display unit to display an image;

at least one dummy pixel positioned in a dummy display unit in order to generate light with predetermined luminance;

at least one photodiode arranged on the dummy display unit to be paired with and adjacent to the dummy pixel to detect light emitted by the dummy pixel; and a sensing unit disposed to extract first resistance information from organic light emitting diodes (OLED) included in the effective pixels, extract second resistance information from an OLED included in the dummy pixel, and extract luminance information corresponding to the second resistance information from the photodiodes, each of the effective pixels and the dummy pixels comprises:

the OLED;

a second transistor controlling an amount of current supplied from a first power supply to the OLED;

a first transistor having a first electrode continuously coupled to a data line at a first node and a second electrode continuously coupled to a gate electrode of the second transistor, the first transistor being turned on when a scan signal is supplied from a scan line to its gate electrode; and a third transistor having a first electrode continuously coupled to an anode electrode of the OLED and a second electrode continuously coupled to the data line at the first node, the third transistor being turned on when a first control signal is supplied from a first control line to its gate electrode.

14. The organic light emitting display as claimed in claim 13, wherein the sensing unit supplies a current in a period where the third transistor is turned on to extract a voltage applied to the OLED as the first resistance information or the second resistance information.

* * * * *